US005203824A

United States Patent [19]

Henke et al.

[11] Patent Number: 5,203,824

[45] Date of Patent: Apr. 20, 1993

[54] METHOD AND APPARATUS FOR PREPARING THE SURFACE OF A REGION OF SOIL FOR FURTHER TESTING

[76] Inventors: Robert Henke; Wanda K. Henke, both of 7 Wyndam Ct., Lutherville, Md. 21093

[21] Appl. No.: 763,826

[22] Filed: Sep. 23, 1991

[51] Int. Cl.[5] ..... G01N 1/08; E21B 7/28; E21C 7/08

[52] U.S. Cl. ..... 73/864.43; 175/65; 175/203

[58] Field of Search ..... 73/864.41, 864.44, 864.45, 73/863, 864.43, 151; 175/65, 67, 203; 405/248

[56] References Cited

U.S. PATENT DOCUMENTS

| | | | |
|---|---|---|---|
| 126,729 | 5/1872 | Meatyard | 175/67 |
| 1,883,013 | 10/1932 | Shinn | 175/203 |
| 1,927,871 | 9/1933 | Irwin et al. | 73/864.43 |
| 2,294,318 | 8/1942 | Rich | 175/203 |
| 3,185,226 | 5/1965 | Robbins | 175/203 |
| 3,416,374 | 12/1968 | Smith | 73/864.43 |
| 3,952,816 | 4/1976 | Takano et al. | 175/67 |
| 4,174,759 | 11/1979 | Arbuckle | 175/67 |
| 4,372,399 | 2/1983 | Cork | 175/65 |
| 4,646,855 | 3/1987 | Dellinger | 175/65 |
| 4,738,320 | 4/1988 | Bardin et al. | 175/65 |

FOREIGN PATENT DOCUMENTS

| | | | |
|---|---|---|---|
| 0379847 | 4/1973 | U.S.S.R. | 73/864.43 |
| 0398859 | 9/1973 | U.S.S.R. | 73/864.44 |

*Primary Examiner*—Hezron E. Williams
*Assistant Examiner*—George M. Dombroske
*Attorney, Agent, or Firm*—Arnold, White & Durkee

[57] ABSTRACT

A method and apparatus for preparing the surface of a region of soil for further testing involves the gradual removal of soil disturbed during the drilling of a borehole. An initial hole may be bored with an auger having a removable nose cone, then a trimming tool may be pushed into the borehole and rotated so as to gradually and controllably remove the soil as the tool is advanced. This removal of the soil portion disturbed during drilling results in the preparation for testing of a soil sample which is less affected by the drilling operation itself and therefore more representative of the actual soil conditions.

8 Claims, 3 Drawing Sheets

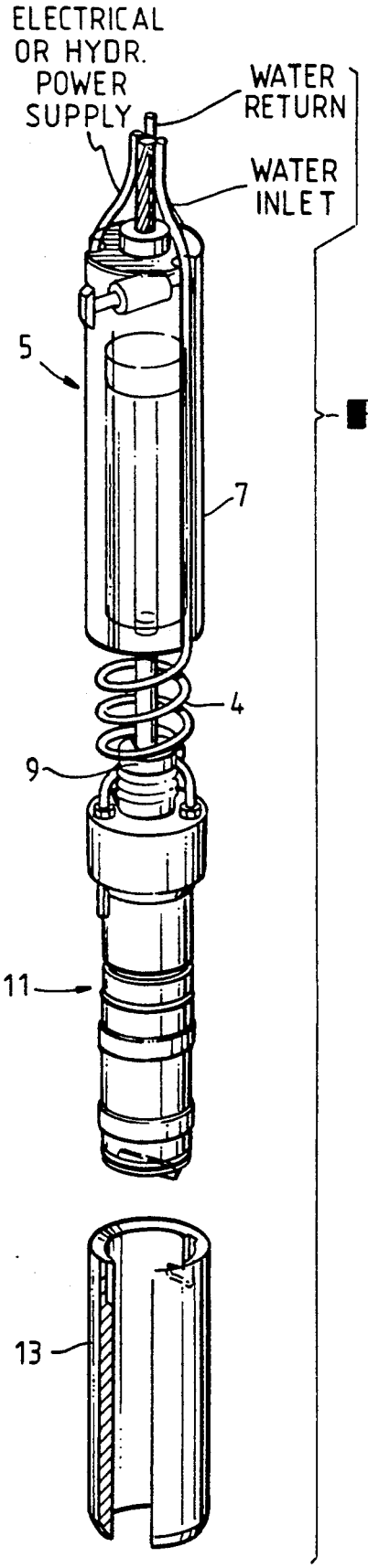
FIG.2
FIG.3
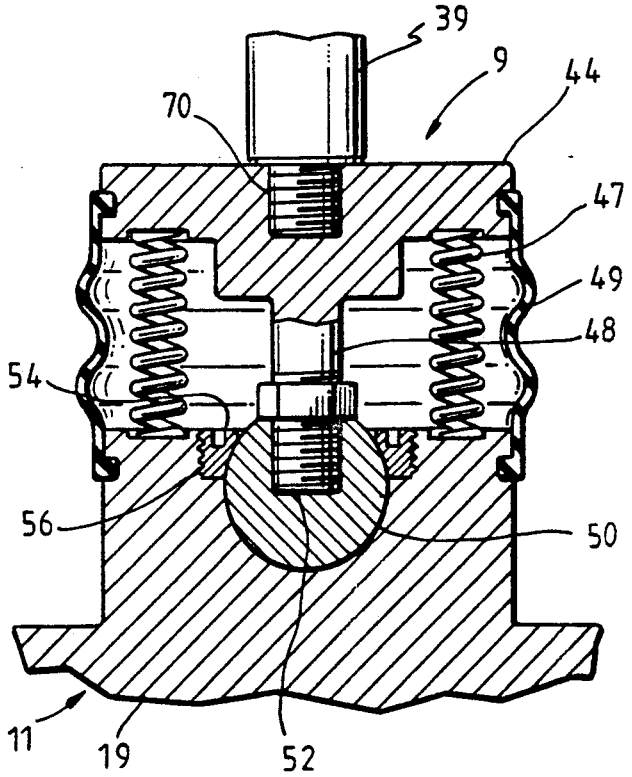

FIG.4
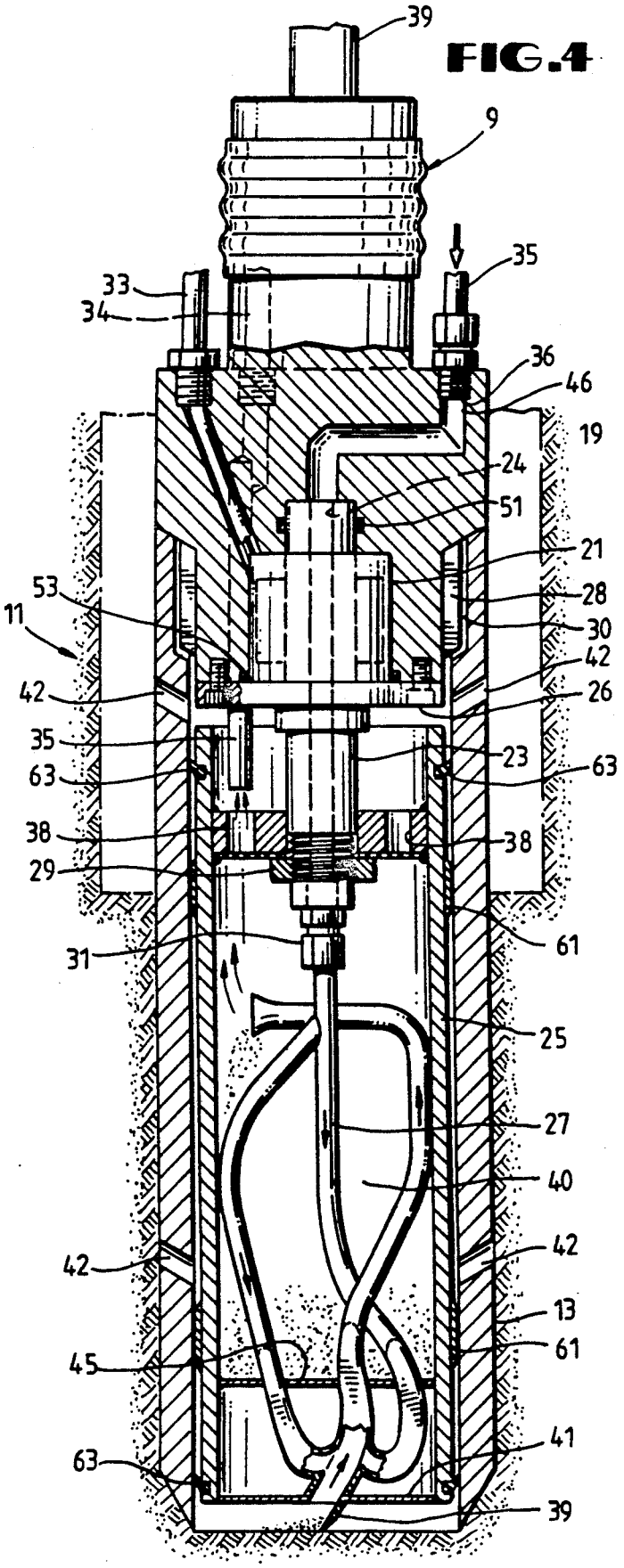
FIG.5A
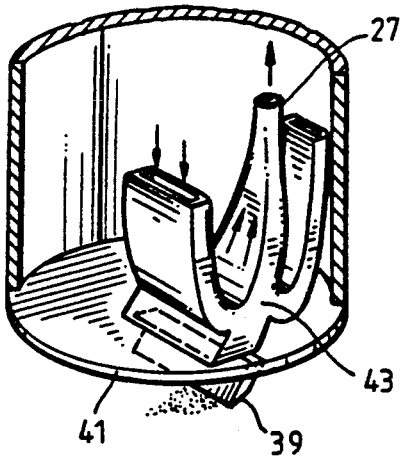
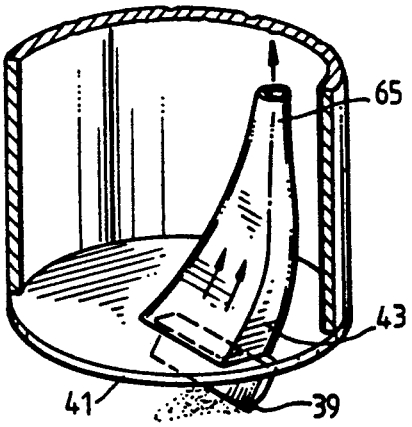
FIG.5B

METHOD AND APPARATUS FOR PREPARING THE SURFACE OF A REGION OF SOIL FOR FURTHER TESTING

BACKGROUND OF THE INVENTION

1. Field of the Invention

This invention relates generally to techniques for testing soils, and particularly, to techniques for preparing the surface of a region of soil for further testing.

2. Background Art

It is often important to determine, for example, at least by estimate, the resistance of a soil to liquefaction, the degradation characteristics of a soil, the dynamic shear modulus of a soil at low levels of shear deformation, and the variation in the dynamic shear modulus of a soil with shear deformation. Liquefaction is the total loss of the stiffness and strength of a saturated soil caused by increased pore water pressure which can result from cyclic loading. Degradation is the reduction in stiffness also due to the buildup of pore water pressure caused by cyclic loading. Degradation may or may not lead to liquefaction depending upon the type and state of the soil. Generally, the shear modulus of a soil is a function of shearing deformation. For example, most soils show reduced stiffness with increasing deformation under monotonically increasing loading.

Commonly, these properties, as well as others, are necessary for analysis which predicts the response of a site or foundation structure system to dynamic loading caused by earthquakes, ocean waves or mechanical vibrations. Conventionally, these properties have been determined by conducting laboratory tests on samples recovered from a site or by in situ field tests.

Laboratory testing of soil samples suffers from a number of problems. Particularly, the acts of recovering a sample, transporting it to a laboratory, and preparing the sample for a test, can so disturb a sample from its original state as to render questionable any test results obtained therefrom. In addition, it is often difficult to reproduce the original field environment (state of stress) of the sample because it is often difficult and costly to define the environment and because typical laboratory test apparatus are limited in their ability to reproduce environmental conditions. Therefore, laboratory tests are subject to error due to their failure to precisely account for environmental considerations. Safely accounting for the affects of these disturbances and the inability to maintain or reproduce existing environmental conditions in the laboratory may lead to excessively costly structures.

There are a variety of devices and means that are used to collect data, such as that referenced above, from a given soil sample during in situ testing. For example, a closed ended probe may be (1) penetrated into the ground at a controlled slow rate, thus simulating static noncyclic loading, but at the same time introducing severe failure into the local soil, or (2) driven into the ground by violent impacts, thereby causing severe and immediate failure of the soil adjacent to the cylinder. Also, as disclosed in one embodiment of applicants' U.S. Pat. No. 4,594,899, an open ended cylindrical device, with an inner cylinder that is rotated by an impulse or by an oscillatory motion, can also be used to collect the above referenced data. However, irrespective of the devices used to derive the sample to be tested, the test results may be affected by the disturbance of the soil due to the initial drilling of the borehole. The influence of the disturbance of the soil due to initial drilling of the borehole could have a significant impact on any measured data obtained.

The accuracy and consistency of the results of soil testing can be improved through the use of the present method and apparatus for preparing the surface of the soil prior to testing. In particular, the present invention, by lessening the soil disturbance in the area adjacent the soil sample, reduces uncertainties present with prior data accumulation methods and devices.

SUMMARY OF THE INVENTION

In accordance with one preferred embodiment of the present invention, a method of preparing the surface of a region of soil that is to undergo further soil testing includes the initial step of drilling a borehole with an auger, or like device, having a removable nose cone section. The method further includes the steps of inserting a soil removal apparatus into the auger body which is then used to gradually trim and remove the soil at the bottom of the borehole in a controlled manner as it is gradually advanced in a downward direction. This gradual and controlled trimming of the soil results in a substantially smooth surface that is essentially perpendicular to the longitudinal axis of the auger body. That surface is thereby adapted to receive a variety of testing instruments to measure desired soil parameters or sampling instruments to recover samples for further laboratory testing.

In accordance with another preferred embodiment of the present invention, a soil removal apparatus is provided to prepare the surface of a sample. A trimming tool removes the soil existing at the bottom of the initial borehole in a controlled manner as it is gradually advanced in a downward direction by a hydraulic cylinder. This device provides a controllable and gradual means for removing the soil that has been disturbed due to the initial drilling. Furthermore, when the device is used, it can provide a substantially flat and level surface for further testing and enables the testing to be performed on a sample that has suffered very minimal disturbance. By providing such a sample, the test data will be more representative of actual soil conditions.

The method and apparatus of the present invention is directed towards improving the accuracy of measurements of various soil properties by reducing the effects of the localized disturbance of the soil caused by the initial drilling process. By use of the method and apparatus of this invention, more accurate and more consistent data can be obtained, thereby resulting in better structural designs.

BRIEF DESCRIPTION OF THE DRAWINGS

FIG. 2 is an elevational view of the components of one embodiment of the present invention;

FIG. 3 is a cross-sectional view of a coupling useful with one embodiment of the present invention;

FIG. 4 is an enlarged, partial cross-sectional view showing one embodiment of the trimming tool of the present invention; and FIGS. 5A and 5B are cut away views of the lower portion of the trimming tool, shown in FIG. 4.

DESCRIPTION OF THE PREFERRED EMBODIMENTS

Figure 1A:
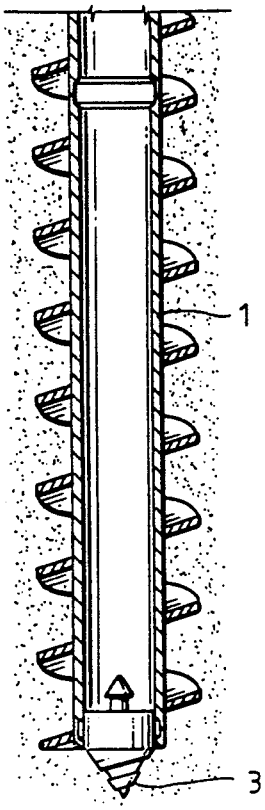
FIG. 1A is a cross-sectional view of the drilling of an initial borehole by means of an auger with a removable nose cone.

Referring to the drawings wherein like reference characters are used for like parts throughout the several views, FIG. 2 depicts a soil removal apparatus 5 that comprises a hydraulic cylinder 7, a coupling 9, a trimming tool 11, and a casing 13.

As shown in FIG. 3, the shaft 39 from the hydraulic cylinder 7 may be connected to the motor housing 19 of trimming tool 11 by means of a coupling 9. The shaft 39 is connected to coupling 9 by threaded connection 70. In particular, the coupling 9 consists of upper flange 44 having rod extension 48 formed thereon, said rod extension 48 connected to ball 50 by means of threaded connection 52. The ball 50 is secured to motor housing 19 by means of a retaining ring 54 which is connected to motor housing 19 by threaded connections 56. A plurality of springs 47 and a flexible dust boot 49 are disposed around the circumference of the coupling 9 and the motor housing 19. In operation, the trimming tool 11 is free to rotate on the ball 50, thereby providing a means of accommodating misalignment between shaft 39 and vertical axis of trimming tool 11. Other commonly available coupling mean for connecting a shaft to another object may be used in place of the illustrated coupling.

Referring to FIG. 4, the trimming tool 11 comprises a variable speed motor 21 disposed in a motor housing 19 having shaft 23 with hole 24 drilled therethrough. The motor 21 can be an electric or hydraulic motor. The motor 21 is mounted in motor housing 19 by means of a plurality of threaded connectors 26. A rotary seal 51 is provided between shaft 23 and motor housing 19. Additionally, a stationary seal 53 is provided between the motor 21 and the motor housing in the area adjacent the threaded connections 26. The motor housing 19 is provided with a plurality of circumferentially disposed external vanes 28 that are disposed within grooves 30 in casing 13. The vanes provide a means for preventing rotation of casing 13 when the motor 21 is actuated and causes movement of tool housing 25. Additionally, or alternatively, vanes and grooving could be provided on the motor and auger housing to rotationally secure the motor housing to the auger.

Additionally, wear bands 61 and wiper seals 63 are attached to tool housing 25. The wear bands 61 and wiper seals 63 provide for a friction fit between casing 13 and tool housing 25. This friction fit is sufficient to hold casing 13 to the tool housing 25 as the soil removal apparatus 5 is lowered into the auger body 1 during the initial steps of trimming the soil as provided for by this invention. Additionally, or alternatively, hydraulically actuated latches or clamps could be used to hold casing 13 to the tool housing 25 or motor housing 19.

The motor housing 19 has several connections for various utilities. In particular, there is a water inlet 35, an inlet for electrical or hydraulic power supply to the motor 21, and a water outlet 34 for pumping excess water from the area adjacent the trimming operations to the surface for disposal thereof. The water or fluid introduced into circulating fluid hose assembly 27 from the surface, flows through water inlet 35, channel 46 formed in motor housing 19, and through the opening 24 in motor shaft 23.

As will be apparent from observation of the drawings, the tool housing 25 is attached to the lower end of shaft 23 by means of a nut 29. The tool housing 25 is disposed within casing 13. The circulating fluid hose assembly 27 is connected to shaft 23 by means of a fitting 31. Additionally, a water passage 35 is extended and disposed adjacent shaft 23. The tool casing 25 also contains a plurality of openings 38 which allow excess ground water, or the like, in the lower compartment 40 to escape via means of water passage 35. There is also provided a plurality of openings 42 in casing 13 to avoid fluid pressure buildup or to allow fluid, such as ground water, or the like, to flood the annular space between tool housing 25 and casing 13, thus ensuring that the area adjacent trimming blade 39 remains flooded. The tool housing 25 is also provided with a lower plate 45 through which the various components of the circulating fluid hose assembly 27 penetrate. There is also a bottom plate 41 formed in tool housing 25 having a trimming blade 39 attached thereto. Immediately above plate 41 is collection head 43 to which circulating fluid hose assembly 27 is connected. It should be noted that, in lieu of said trimming blade 39, a roller or other like attachment could be affixed to tool housing 25, thus providing a very slow and controlled rate of removal of the soil immediately above the sample to be tested.

The trimming blade 39, attached to plate 41, extends across approximately one half of the diameter of the tool housing 25. The angle of the blade 39 relative to the soil surface is dependent upon the existing soil conditions of each particular application. In a preferred embodiment of the invention, the blade is dispose 45 degrees relative to the surface of the soil to be sampled. However, the present invention is not considered to be limited to any particular angulation of the trimming blade. The trimming blade 39 may be made integral with plate 41 or it may be attached by bolting or the like.

As will be apparent, when electrical or hydraulic power is supplied to motor 21, shaft 23 will rotate thus causing tool housing 25 and trimming blade 39, to rotate in the same direction.

The controlled rotation of trimming blade 39, coupled with the gradual advance of the casing 13 and tool housing 25 provided by the hydraulic cylinder 7, provides a readily controllable means for gradual removal of the soil that is in contact with trimming blade 39. As trimming blade 39 rotates, the particles of soil removed thereby are carried away by the water or drilling fluids circulating through circulating fluid hose assembly 27. In operation, some of the removed soil will remain entrained in the water within the lower compartment 40. However, most of the soil particles will collect on the upper surface of plate 45 in tool housing 25.

It is envisioned that a trimming tool 11 with circulating fluid hose assembly 27, which is used to remove particles resulting from the trimming operations, will be used in environments in which the soil to be sampled is very wet or even below the existing water table. For dry environments, such as would be encountered in the desert regions of Arizona or the like, a slight modification to the present invention is shown in FIG. 5B, wherein the soil that is dislodge as a result of the trimming operations is removed by means of a vacuum system. In particular, as shown in FIG. 5B, a vacuum hose 65 is used in lieu of the circulating fluid hose assembly 27 shown in FIG. 5. The vacuum hose assembly in turn is connected to shaft 23 and collection head 43. It will be apparent that in operation the vacuum system accomplishes the same purpose as the circulating fluid and hose assembly 27, i.e., it removes the particles resulting from the trimming operations. The source of the vacuum can be a vacuum pump (not shown), or like device, located on the surface.

Figure 1B:
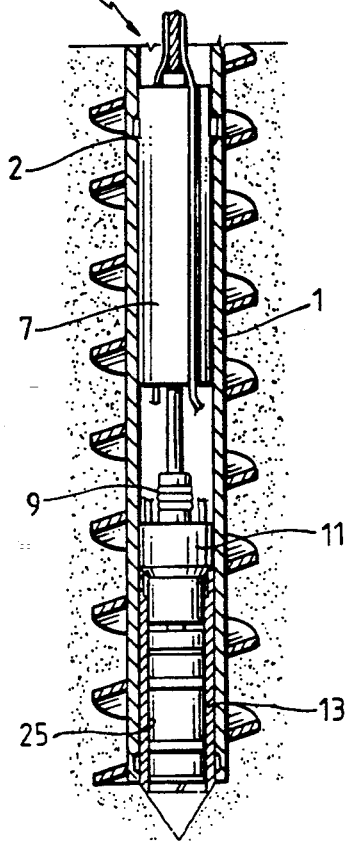
FIG. 1B is a partial, cross-sectional view of the auger with one embodiment of the soil removal device of the present invention installed therein.

One method for using the soil removal apparatus 5 is shown in FIGS. 1A through 1D. In particular, as shown in FIG. 1A, a borehole is drilled using an auger 1 having a wireline retrievable nose cone 3 which is removed upon drilling the initial borehole to a desired depth. Thereafter, as shown in FIG. 1B, the soil removal apparatus 5 is inserted into the auger body 1, and secured thereto via hydraulic clamps 2 that attach to the hydraulic cylinder 7. The hydraulic clamps 2 are disposed within, and attached to, auger body 1. After the soil removal apparatus 5 is lowered to the proper position within the auger body, the hydraulic clamps 2 are actuated from the surface so as to engage soil removal apparatus 5, thus securing the apparatus for further operations. In normal operation, the auger body may remain in place after the initial drilling of the borehole. However, the auger may also be removed from the borehole and reinserted, or a separate cylinder may be inserted into the borehole after the initial drilling operations.

Figure 1C:
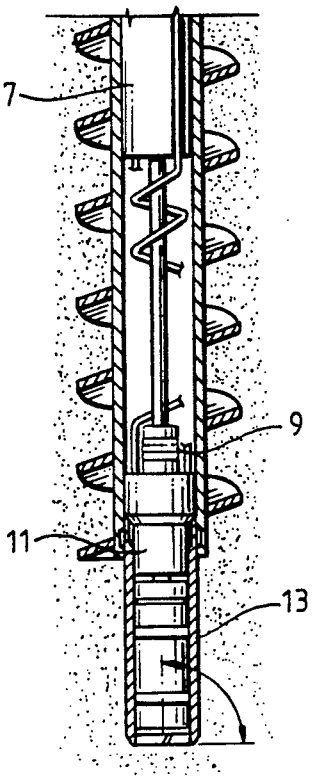
FIG. 1C is a partial cross-sectional view of one embodiment of the present invention extended into the ground during trimming operations.

As shown in FIG. 1C and 4, the hydraulic cylinder 7 is actuated so as to gradually push the trimming tool 11 and casing 13 downwardly as the motor 21, within trimming tool 11, causes rotation of trimming blade 39 about the axis of the hole. This operation gradually trims or scrapes the top layer of soil as the trimming tool is advanced downwardly. The soil dislodged by the trimming operation is removed through the circulating fluid hose assembly 27. The fluid circulating through the circulating fluid hose assembly 27 may be water or any commonly used drilling fluid or mud. The fluid may be introduced from the surface through water inlet 35. This operation is continued until the desired depth is reached. As shown in FIG. 2, the cable and hoses 4, that are used to provide the necessary utilities for operation of the device, are loosely coiled around hydraulic cylinder 7, thereby allowing the downward movement of trimming tool 11.

Figure 1D:
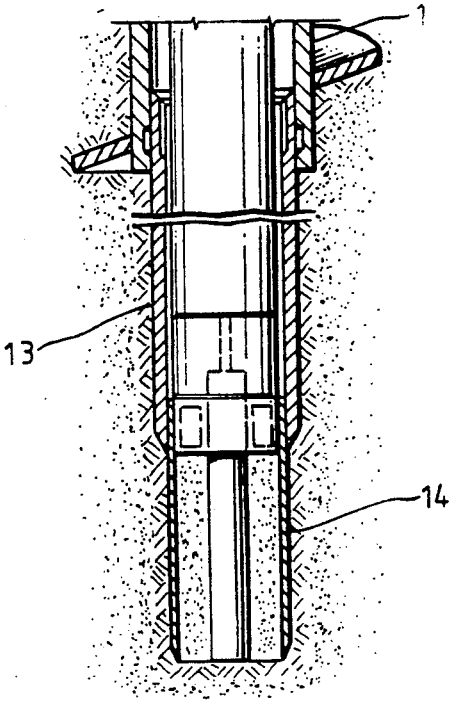
FIG. 1D is a partial cross-sectional view of a casing after trimming operations have been completed, the soil removal device has been removed from the hole, and a probe has been penetrated into the soil below the casing.

Thereafter, the soil removal apparatus 5 may be removed from the auger body 1 while the casing 13 remains in place, resulting in the configuration shown in FIG. 1D. FIG. 1D also shows a sensing tool 14, such as that previously described by the applicants in their U.S. Pat. No. 4,594,899, which patent is hereby expressly incorporated by reference herein. However, it should be understood that the present invention is not to be limited by the particular sensing tool or device that is used after the testing surface has been prepared.

It should also be understood that the hydraulic cylinder 7, as shown in FIG. 2, is not the only means of gradually pushing the trimming tool 11 downwardly. Rather, the downward force could be provided by devices such as a pneumatic cylinder or an electric motor with an advancing screw actuated, by use of a gear connected to the shaft of said motor. The downward force could also be provided by a device anchored on the surface of the ground with an appropriate rod extension to contact coupling 9 of the present invention.

We claim:

1. A soil removal device adapted for removing soil from a region adjacent the bottom of a borehole, comprising:

means for trimming soil from a bottom region of an initial borehole, said trimming means including a tubular retainer, said tubular retainer having a length much less than the length of the borehole; and means for advancing said trimming means and said tubular retainer below said borehole, to remove soil from below said borehole, said tubular retainer being detachably connected to said advancing means so that said tubular retainer may be left below said borehole when said advancing and trimming means are removed.

2. A soil removal device, as recited in claim 1, further comprising a means for removing the soil dislodged by said trimming means.

3. A soil removal device, as recited in claim 2, further comprising upper and lower chambers, said upper chamber adapted to store said soil dislodged by said trimming means.

4. A soil removal device, as recited in claim 1, wherein said trimming means is adapted to form a hole of a smaller diameter compared to the diameter of said borehole.

5. A soil removal device adapted for removing soil from a region adjacent the bottom of a borehole, comprising:

a trimming tool arranged to gradually scrape soil from the bottom surface of the borehole, said trimming tool including a tubular retainer, said tubular retainer having a length much less than the length of the borehole, said tubular retainer being detachable from said trimming means so as to remain below said hole when said trimming tool is removed;

a tool rotating device adapted to rotate said trimming tool about the longitudinal axis of said borehole; and means for removing soil scraped from the bottom of the borehole.

6. A soil removal device, as recited in claim 5, wherein said means for removing said scraped from the bottom of the borehole comprises a fluid circulation system.

7. A soil removal device as in claim 5 further comprising upper and lower chambers, said upper chamber adapted to store said soil removed by said removing means.

8. A soil removal device, as recited in claim 5, wherein said trimming means is adapted to form a hole of a smaller diameter compared to the diameter of said borehole.

* * * * *